US005188333A

United States Patent [19]

Schumacher et al.

[11] Patent Number: 5,188,333

[45] Date of Patent: Feb. 23, 1993

[54] SUPPORT FOR AIR CONDITIONING UNIT

[75] Inventors: J. Gunther Schumacher; Maurizio Lattanzio, both of Richmond Hill, Canada

[73] Assignee: Spinnaker Industries Inc., Concord, Canada

[21] Appl. No.: 731,108

[22] Filed: Jul. 15, 1991

[51] Int. Cl.[5] ..... F16M 3/00

[52] U.S. Cl. ..... 248/676; 220/4.09; 248/224.4

[58] Field of Search ..... 248/676, 672, 637, 150, 248/165, 224.4, 225.1, 678; 103/56.1; 62/254.1; 220/4.09, 4.11

[56] References Cited

U.S. PATENT DOCUMENTS

| | | | |
|---|---|---|---|
| 1,500,917 | 2/1924 | Bell | 220/4.09 |
| 2,218,220 | 10/1940 | Riehl | 101/404 |
| 2,660,271 | 11/1953 | Hupp | 189/36 |
| 2,882,810 | 4/1959 | Goettl | 248/237 X |
| 4,399,975 | 8/1993 | Trimarco et al. | 248/678 |
| 4,423,978 | 1/1984 | Tiegelmann | 248/224.4 X |
| 4,635,562 | 1/1987 | Kreeger | 108/56.1 X |
| 4,887,399 | 12/1989 | Berger et al. | 52/27 |
| 4,895,066 | 1/1990 | Carnahan | 98/42.22 |
| 4,916,918 | 4/1990 | Marelli | 248/678 X |
| 4,917,345 | 4/1990 | Czech | 248/678 |

*Primary Examiner*—Ramon O. Ramirez
*Attorney, Agent, or Firm*—Baker & Daniels

[57] ABSTRACT

A frame for supporting a piece of equipment, particularly an air conditioning unit, onto the roof of a building is constructed using fastener means integral to the sheet metal so that the use of nuts, bolts or other fastening devices is eliminated. In particular, the fastening means comprises a slot cut into one piece of sheet metal and a dimple and tongue punched out of a second piece of sheet metal. The tongue is slipped into and over the slot until the dimple locks into the slot and thus holds the two pieces of sheet metal together.

13 Claims, 3 Drawing Sheets

SUPPORT FOR AIR CONDITIONING UNIT

The present invention is concerned with a support for a piece of equipment and more particularly with a support for mounting air conditioning units on the roof of a building.

During the installation of air conditioning units on the roofs of buildings, numerous problems are encountered. One such problem is related to the use of a support or frame upon which the air conditioning unit is mounted.

Supports for air conditioning units are usually custom built in properly equipped shops and then installed on the building roof. Because most supports involve complicated assembly procedures, this procedure usually requires repeated travel between the shop and the building to ensure the support is built so as to fit properly.

Such supports are built of sheet metal, which must be fastened and held together. In some cases, the sheet metal is welded together, but this is problematic because if the welding is done at the shop, the completed support must be transported to the building and mounted on the roof. On the other hand, if the welding is done on site, the welding equipment must be transported to the site and the welding is done on the roof, which can be awkward.

Another way of securing the sheet metal together so as to form a support is by using nuts and bolts. However, this requires ensuring that sufficient nuts and bolts are taken to the roof of the building. Also, nuts and bolts may have to be installed in hard to reach places, making installation difficult. Finally, using nuts and bolts creates a danger in the sense that there is a likelihood that a workman may drop a nut or bolt down the ventilation shaft and into equipment.

U.S. Pat. No. 2,882,810 issued Apr. 21, 1959 discloses an Adjustable Support for Evaporative Coolers wherein neither welding nor nuts and bolts are used. However, the support's sides are secured to one another by clips that slide over flanges extending from the sides. The clips are not integral to the frame and thus present the same problems as nuts and bolts do.

U.S. Pat. No. 4,887,399 issued Dec. 19, 1989 discloses a frame made of individual elements interconnected by brackets, which appear to have to be bolted or secured by metal screws to the support. Again, this presents the same problem.

In general terms the present invention provides a frame for supporting a piece of equipment on the roof of a building comprising a plurality of walls each having portions overlapping with portions of the other walls, a plurality of spaced apart fastener means integral to the walls and located on the overlapping portions and adapted to hold the walls together such that the walls define a frame.

More particularly the invention provides a frame for supporting a piece of equipment on the roof of a building in which the walls are held together by fastening means comprising a slot, a tongue adapted to slip into and over the slot and a dimple adapted to lock into the slot when the tongue is slipped over the slot.

In another aspect the invention provides a fastening device for securing a pair of panels together comprising a tongue integrally formed in one of the panels and which is generally parallel to the panel and is connected to the panel such that a channel is defined between the tongue and the panel. The device further comprises a latching member spaced from the tongue and directed in an opposite direction to the channel, and an aperture in the other panel having a length sufficient to accommodate the tongue and to extend beyond the latching member so that relative movement between the panels is prohibited.

One embodiment of the present invention is illustrated in the accompanying drawings, in which like numerals denote like parts throughout the several views and in which.

Figure 1:
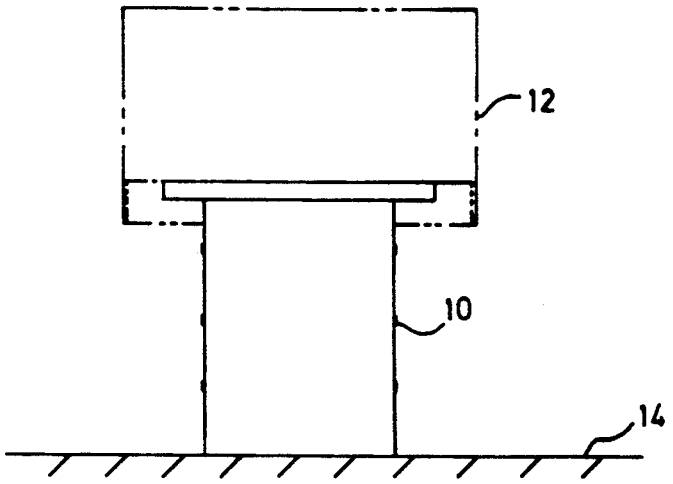
FIG. 1 is a side elevational view of a frame for supporting a piece of equipment.
Figure 2:
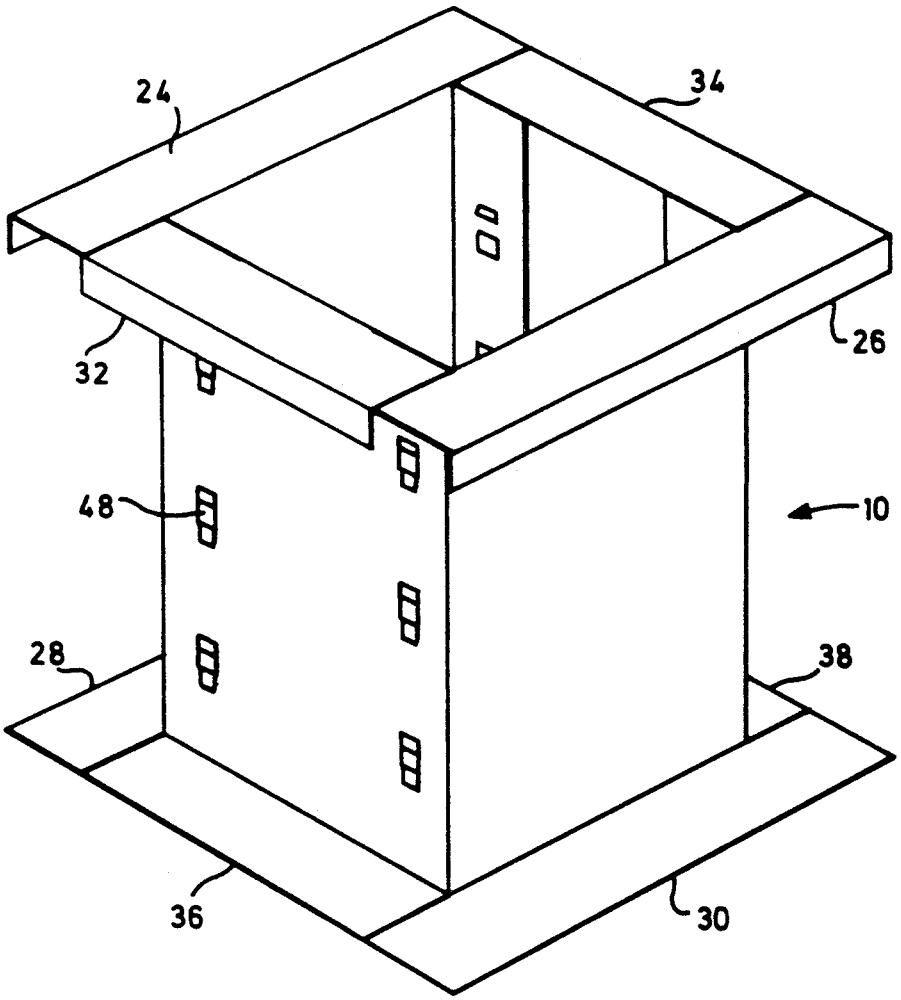
FIG. 2 is a perspective view of the frame in FIG. 1.
Figure 3:
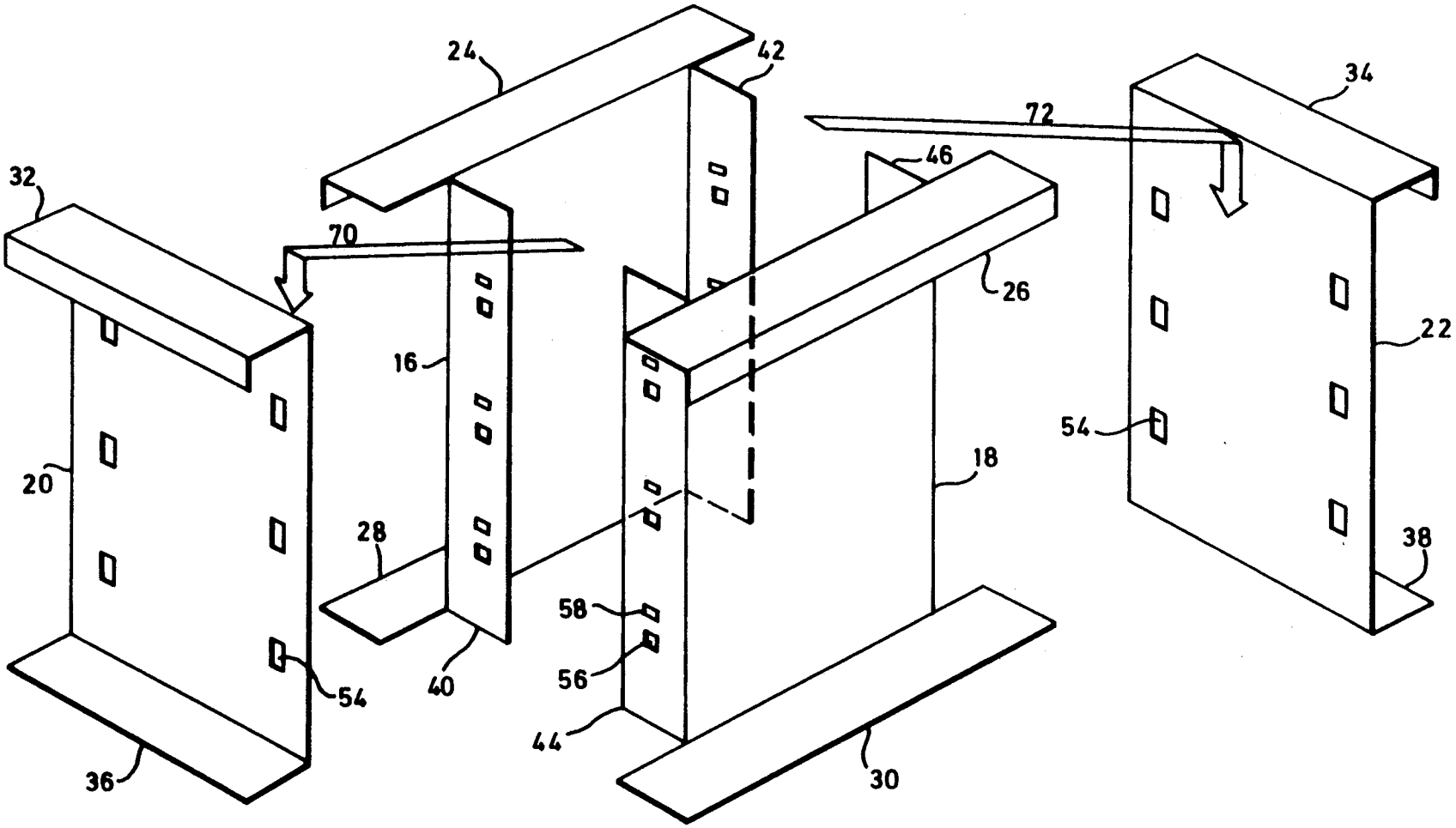
FIG. 3 is an exploded perspective view of the frame in FIG. 1.

With reference to FIGS. 1, 2 and 3 there is shown a frame 10 for supporting a piece of equipment 12, particularly an air conditioning unit, on the roof of a building 14.

As seen more clearly in FIGS. 2 and 3, the frame comprises two side walls 16 and 18 and two end walls 20 and 22. Side walls 16 and 18 and end walls 20 and 22 are panels having substantially flat top and bottom surfaces. Side walls 16 and 18 and end walls 20 and 22 are preferably made of somewhat resilient or deformable material such as sheet metal or the like, having a small thickness relative to their lengths and widths. Side walls 16 and 18 both have top flanges 24 and 26 respectively and bottom flanges 28 and 30 respectively. End walls 20 and 22 also have top flanges 32 and 34 respectively and bottom flanges 36 and 38 respectively. Top flanges 24 and 26 and bottom flanges 28 and 30 are each longer than the widths of side walls 16 and 18 such that when end walls 20 and 22 are fastened to side walls 16 and 18, the top flanges define a continuous peripheral flange around the top of the frame and the bottom flanges define a continuous peripheral flange around the bottom of the frame.

Side wall 16 also includes side flanges 40 and 42 which extend perpendicularly to the plane of side wall 16 so as to lie alongside end walls 20 and 22 respectively. Similarly, side wall 18 also comprises side flanges 44 and 46 which extend perpendicularly to the plane of side wall 18 so as to lie alongside end walls 20 and 22 respectively.

Side walls 16 and 18 are oriented such that side flanges 40 and 42 of side wall 16 extend towards side flanges 44 and 46 of side wall 18. End walls 20 and 22 are each made so that a portion thereof overlaps with each of side flanges 40, 42, 44 and 46.

A plurality of fasteners 48 are located on each of side flanges 40, 42, 44 and 46 and on each of the portions of end walls 20 and 22 which overlap with the respective side flanges. Fasteners 48 are aligned in a substantially vertical direction along the respective side flanges and respective portion of end walls 20 and 22.

Referring to FIGS. 4 to 8, fastener 48 comprises a slot 54 cut into one of the components, in this case panel 50, a tongue 56 punched out of the second component, panel 52 and a latch 58 also punched out of panel 52.

Tongue 56 and latch 58 are integral to panel 52. Tongue 56 is connected to panel 52 by a connector 60, which extends substantially perpendicularly to panel 52. Tongue 56 is generally parallel to panel 52 and is spaced apart from the top surface of panel 52 such that the channel 62 defined by the bottom surface of tongue 56 and the top surface of panel 52 is sufficient to allow the thickness of panel 50 to slide within channel 62.

Latch 58 is also punched out from panel 52, and therefore is integral to panel 52. The end 64 of latch 58 is raised above the top surface of panel 52 to a point just before end 64 is raised completely above the top surface plane of panel 52. Latch 58, being integral to panel 52, is somewhat resilient or deformable such that end 64 can be lowered upon the application of pressure thereon.

Figure 6:
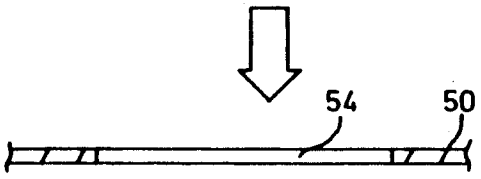
FIG. 6 is a sectional view taken from the line 6—6 of FIG. 5.
Figure 6:
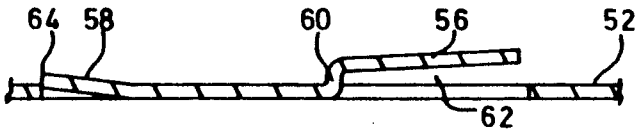
Figure 7:
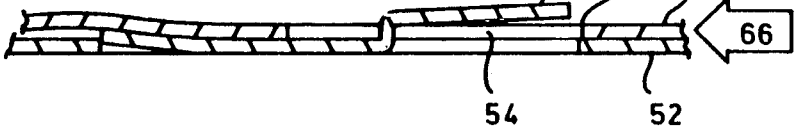
FIG. 7 is a sectional view taken from the line 6—6 of FIG. 5 showing the components partly assembled.
Figure 8:
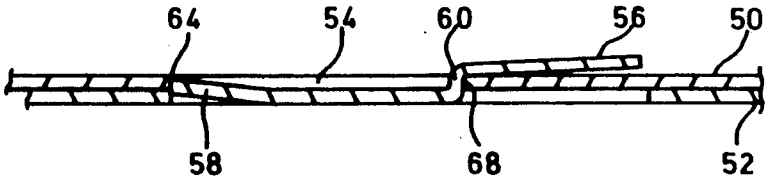
FIG. 8 is a sectional view taken from the line 6—6 of FIG. 5 showing the components fully assembled.
Figure 4:
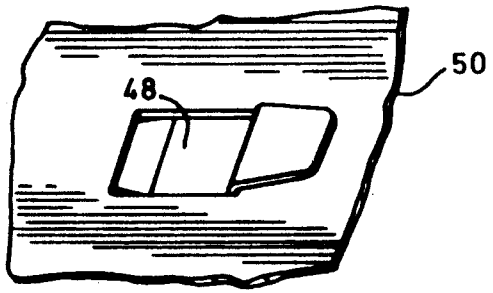
FIG. 4 is a perspective view of a portion of the frame of FIG. 1 showing the manner in which two components are fastened.
Figure 5:
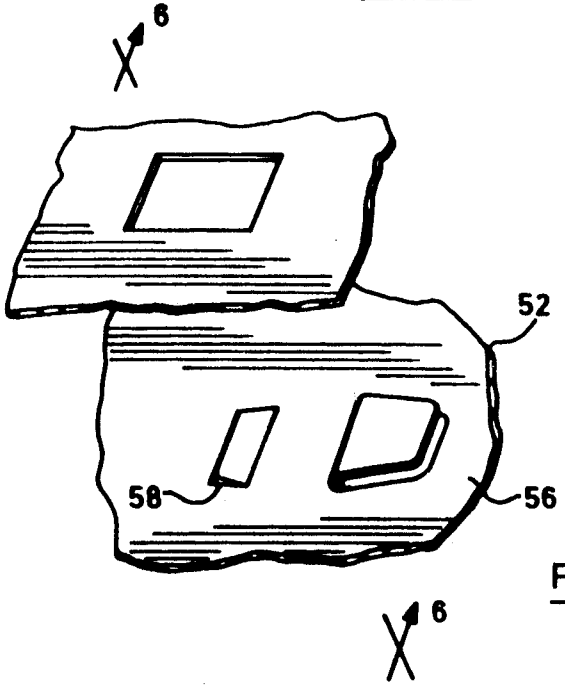
FIG. 5 is a perspective view of the portion in FIG. 4 showing the two components apart.

The operation of fastening panel 50 to panel 52 is more clearly shown in FIGS. 6, 7 and 8. Panel 50 is brought towards panel 52 such that tongue 56 slips into slot 54 and until the bottom surface of panel 50 abuts with the top surface of panel 52.

Panel 50 is then slid along panel 52 in the direction illustrated by arrow 66. Latch 58 is deformable therefore allowing the bottom surface of panel 50 to slide over latch 58. As panel 50 is moved in the direction of arrow 66, tongue 56 slides over slot 54 and overlies a portion of panel 50 adjacent to edge 68 of slot 54. Eventually, edge 68 of slot 54 will contact with the inner surface of connector 60 of tongue 56.

The length of slot 54 is such that it is equal to or slightly greater than the distance between end 64 of latch 58 and the inner surface of connector 60 of tongue 56. As such, when edge 68 of slot 54 contacts the inner surface of portion 60, end 64 of latch 58 snaps into slot 54 thereby causing panel 50 to be secured to and held together with panel 52. Latch 58 prevents movement of panel 50 in a direction opposite to arrow 66, therefore allowing tongue 56 to overlie a portion of panel 50. Tongue 56 therefore prevents movement of panel 50 away from panel 52.

It is to be understood that the components of fastener 48 can be interchanged such that slot 54 is located on panel 52 and tongue 56 and latch 58 are located on panel 50.

FIG. 3 further illustrates the operation of fastener 48 in the context of a frame for supporting a piece of equipment. Tongue 56 and latch 58 are located on side flanges 40, 42, 44 and 46 of side walls 16 and 18. Tongue 56 and latch 58 are oriented in a substantially vertical direction. Slots 54 are located on the portions of end walls 20 and 22 which overlap with the side flanges. To secure end walls 20 and 22 onto side walls 16 and 18, side walls 16 and 18 are moved in the direction of arrows 70 and 72 respectively. As such, slots 54 are slipped over tongues 56 and the respective side wall 16 or 18 is then moved in the direction of arrows 70 and 72 so that tongues 56 slide over the portions of side walls 20 and 22 adjacent to slots 54 until latches 58 snap into slots 54. Latches 58 prevent end walls 20 and 22 from moving in the direction of arrows 70 and 72 respectively whereas tongues 56 prevent end walls 20 and 22 from moving away from the side flanges.

When end walls 20 and 22 are fastened to the side flanges of side walls 16 and 18, all four walls define a frame as illustrated in FIG. 2. The respective walls are securely held together by fasteners 48 which are integral to end walls 20 and 22 and side walls 16 and 18. Therefore, the need for welding the walls together or for nuts and bolts or other separate fastening devices is eliminated. The frame 10 can then be secured onto the roof of the building by the peripheral bottom flanges 28, 30, 36 and 38. A piece of equipment 12, particularly an air conditioning unit, can be mounted onto frame 10 and secured onto frame 10 by means of the peripheral top flanges 24, 26, 32 and 34.

While one embodiment of this invention has been illustrated in the accompanying drawings and described hereinabove, it will be evident to those skilled in the art that changes and modifications may be made therein without departing from the essence of this invention, as put forth in the appended claims.

We claim:

1. A frame comprising:

a) a plurality of substantially flat walls having portions overlapping with portions of the other walls; and b) a plurality of spaced apart fastener means integral to the walls and located on the overlapping portions, said fastener means comprising a slot, a tongue adapted to slip into the slot and overlie a portion of the wall adjacent to the slot, and a latching member adapted to lock into the slot when the tongue overlies a portion of the wall adjacent to the slot, the fastener means being adapted to hold the walls together such that the walls define the frame.

2. The frame claimed in claim 1, wherein the overlapping portions include flanges extending from the walls.

3. The frame claimed in claim 2, wherein the flanges extend in a direction generally perpendicular to the walls.

4. The frame claimed in claim 1, wherein the fastener means are oriented in a substantially vertical position.

5. The frame claimed in claim 1, wherein the walls comprise:

a) two substantially flat side walls each having flanges extending therefrom; and b) two substantially flat end walls each having portions overlapping with the flanges.

6. The frame claimed in claim 2, wherein the walls comprise peripheral bottom flanges for fastening to the roof of a building and peripheral top flanges for fastening a piece of equipment to the walls.

7. The frame claimed in claim 5, wherein the tongue and the latching member are oriented in a substantially vertical direction.

8. The frame claimed in claim 5, wherein the tongue and the latching member are integral to the flanges.

9. The frame claimed in claim 5, wherein the slot is located on the overlapping portions of the end walls and the tongue and the latching member are located on the flanges of the side wall.

10. A frame for supporting a piece of equipment on the roof of a building, comprising:

a) two substantially flat side walls;

b) two flanges extending generally perpendicularly from each of the side walls;

c) two substantially flat end walls having portions thereof overlapping with the flanges;

d) a plurality of spaced apart fastener means, comprising a slot, a tongue adapted to slip into the slot and overlie a portion of the wall adjacent to the slot, and a latching member adapted to lock into the slot when the tongue overlies a portion of the wall adjacent to the slot;

e) the fastener means being integral to the flanges and to the overlapping portions of the end walls;

f) the fastener means being oriented in a substantially vertical position; and g) the fastener means being adapted to hold the side walls and the end walls together such that a substantially rectangular structure is defined.

11. The frame claimed in claim 10, further comprising peripheral bottom flanges suitable for fastening the frame to the roof of a building and peripheral upper flanges for fastening a piece of equipment to the frame.

12. A fastening device for securing a pair of panels to one another comprising:

a) a panel retainer having a tongue integrally formed in one of the panels and spaced from but generally parallel to the panel and a connector extending from the tongue to the panel so as to provide an open channel between the panel and the tongue;

b) a latching member spaced from the tongue and providing an abutment surface directed oppositely to the channel;

c) an aperture in the other panel to receive the tongue, the aperture having a length to accomodate the tongue and extend beyond the latching member when the other panel is received in the channel whereby said abutment surface engages a peripheral edge of said aperture and relative movement between the panels is prohibited.

13. The fastening device claimed in claim 12, wherein the length of the aperture is substantially equal to the distance between the abutment surface of the latching member and the channel.

* * * * *